US006530674B2

(12) United States Patent
Grierson et al.

(10) Patent No.: US 6,530,674 B2
(45) Date of Patent: Mar. 11, 2003

(54) METHOD AND APPARATUS FOR JOINING AND ALIGNING FIXTURES

(76) Inventors: Dean Grierson, 3220 Estes St., Wheatridge, CO (US) 80033; Patrick Hersco, 3220 Estes St., Wheatridge, CO (US) 80033

( * ) Notice: Subject to any disclaimer, the term of this patent is extended or adjusted under 35 U.S.C. 154(b) by 0 days.

(21) Appl. No.: 09/079,905

(22) Filed: May 15, 1998

(65) Prior Publication Data

US 2002/0001191 A1 Jan. 3, 2002

(51) Int. Cl.[7] ..... F21S 8/06
(52) U.S. Cl. ..... 362/219; 362/225; 403/292
(58) Field of Search ..... 403/261, 256, 403/249, 230, 292; 362/219, 225, 457, 404, 217

(56) References Cited

U.S. PATENT DOCUMENTS

| | | | | | |
|---|---|---|---|---|---|
| 3,265,886 | A | * | 8/1966 | Wigert | 362/219 |
| 3,894,316 | A | * | 7/1975 | Johnson | 403/361 |
| 3,898,495 | A | * | 8/1975 | Livera | 403/344 |
| 4,416,040 | A | * | 11/1983 | Towsley | 403/330 |
| 4,494,350 | A | * | 1/1985 | Sharp | 403/347 |
| 4,525,973 | A | * | 7/1985 | Vukmanic et al. | 403/346 |
| 4,726,781 | A | * | 2/1988 | Bernhardt et al. | 362/219 |
| 5,624,202 | A | | 4/1997 | Grierson | 403/327 |
| 5,658,066 | A | * | 8/1997 | Hirsch | 362/219 |
| 5,727,870 | A | | 3/1998 | Grierson | 362/225 |

OTHER PUBLICATIONS

Ledalite Architectural Products, Inc. Brochure, Contractor Friendly Linear Lighting Systems, 1996.

* cited by examiner

*Primary Examiner*—Thomas M. Sember
(74) *Attorney, Agent, or Firm*—Holme Roberts & Owen

(57) ABSTRACT

Apparatus and method for joining and aligning fixture modules in an end-to-end relationship, utilizing paired interlocking connectors. The apparatus and method are particularly suited for connecting fluorescent light modules which are suspended from a wall or ceiling, with minimal end-to-end distance between the ends of the fluorescent light tubes in adjacent modules. The connectors are placed at the ends of the modules, with a body portion of each connector adjacent a module end. Tapered tabs, joined to at least one body portion of each pair of connectors, are insertable through tapered openings in the body portion of the other connector in the pair to connect the two modules to each other. The tabs and openings are adapted for interconnection in at least two positions, including a first position for supporting an end of one of the modules while the module is hung and while electrical connections are made between the modules, and a second position where the tabs are fully inserted through the body portion of the adjacent connector to interlock the connectors. The tapered sides of the tabs and the openings aid in aligning the modules as the tabs are inserted through the openings. Each connector may be constructed from a single piece of a suitable material.

25 Claims, 7 Drawing Sheets

METHOD AND APPARATUS FOR JOINING AND ALIGNING FIXTURES

FIELD OF THE INVENTION

The present invention relates generally to the field of modular fixtures for architectural applications, and in particular to connectors for connecting a series of modules to form an elongated fixture. The invention is particularly useful for assembling elongated light fixtures such as are used in suspended, indirect lighting applications.

BACKGROUND OF THE INVENTION

There are a number of architectural settings in which arrays of interconnected modular fixtures are installed. For example, arrays of modular light fixtures can be suspended from a ceiling or otherwise supported, such as by mounting on a wall, in a linear, circular, polygonal, or other geometric array. However, installation of such arrays generally requires that the individual modules of the fixture be physically connected to each other in a precise alignment, both to ensure structural stability of the array and to create an esthetically pleasing appearance.

Installation and alignment of many existing types of suspended arrays require considerable time and labor to ensure proper and precise three-dimensional alignment. In particular, it is typically necessary to support both ends of an initial module while it is being suspended from a wall or ceiling or other support structure, and also while it is being physically connected to an adjacent module. In this regard, one worker typically holds the initial module while another worker attaches hangers at each end of the module. For subsequent modules, the modules are attached by a hanger at one end and to a previously hung module at the other end. For example, one worker may hold the module while another worker attaches the hanger. While the first worker continues to hold the unsupported end, the other worker can then carefully align the module with the previously hung module and use fasteners or the like to interconnect the modules. Installation procedures may be even more complex and time-consuming when additional parts must be positioned within or between fixtures. In the case of light fixtures and other electrical fixtures, for example, it is also necessary to make electrical connections between the fixtures. These operations may have to be conducted in physically cramped and awkward work spaces, where it is difficult to position mechanical parts. It will thus be appreciated that installation and alignment is generally time-consuming, labor intensive and expensive.

In some settings, it is desirable to have arrays of modular fixtures for fluorescent light tubes in which the tubes can be mounted in a manner which minimizes the distance between the ends of tubes in adjacent fixtures to provide a pleasing appearance, more uniform illumination, and/or efficient use of available space for mounting fixtures. For example, fluorescent bulbs are typically available in predetermined lengths, for example, four feet. A designer or client may desire to provide a fixture having a cumulative length of sixteen feet. If such a fixture was assembled using four modules with conventional fixtures having connectors between modules that occupy, perhaps, two or more inches, the resulting fixture could be half a foot or more larger than the desired length. Additionally, at each connection, a dark spot will appear, thereby damaging the illusion of a continuous, customized fixture. It is therefore desirable to minimize the length of connections. However, decreasing the space between the modules and, consequently, the ends of the bulbs, can result in decreased working space for making mechanical and electrical connections between the modules.

SUMMARY OF THE INVENTION

It is an object of the present invention to provide a system and method which allow connection and alignment of modules into fixtures with reduced labor requirements.

It is another object of the present invention to provide a system and method for connecting fluorescent light modules end to end in fixtures with decreased space between the ends of the fluorescent tubes in adjacent modules.

It is yet another object of the present invention to provide a connector and a method for installing modules rapidly and easily in precise three-dimensional alignment.

It is still another object of the present invention to provide a mechanism which supports the fixtures and frees both hands of a worker to make electrical connections.

It is a further object of the present invention to provide a connector and a method for connecting modules utilizing fewer parts and that is less labor intensive than conventional installations.

It is still a further object of the present invention to provide a connector for modular fixtures which can be easily and inexpensively manufactured from readily available and inexpensive materials, and a method for manufacturing such a connector.

These and other objectives are addressed by the connector system of the present invention.

The present invention is directed to connecting and aligning modules of modular fixtures, which may be suspended in an abutted end-to-end configuration from above or from a vertical wall. The present invention simplifies installation of fixtures, with decreased labor requirements relative to previous installation methods. In accordance with the present invention, connectors are mountable to fixtures, preferably substantially inside of and at the ends of the fixture modules.

The fixtures may be electrical fixtures, and more particularly, they may be fluorescent light fixtures. In this regard, connectors are adapted and mountable to the fixtures in a manner that allows fluorescent light tubes in adjacent modules to be aligned end-to-end, with minimal space between the tubes. In addition to using the available space more efficiently for mounting the fixtures, this arrangement of the light tubes eliminates dark spots which detract from the appearance of the fixture array and could decrease the uniformity of the illumination of the space in which the fixtures are mounted.

In accordance with the present invention, when modules are installed in an end-to-end configuration with the end of one module adjacent the end of another module, the connectors at those ends interlock with each other so as to cause the fixtures to be aligned with each other. To achieve this interlocking and self-aligning relationship, at least one of each pair of connectors (e.g., mating connectors of adjacent modules) includes at least one tab member, and at least the other of the two paired connectors includes at least one opening, preferably with a wide central portion and tapered sides. Each tab member also preferably tapers from a wide portion adjacent a joint between the tab member and a body portion of the connector to a narrower portion which is distal from the joint, and each tab member can be positioned to extend outward from the end of the module to which it is mounted. Preferably, the tab member(s) is deployable from a first position where the tab member is flush with the body portion (e.g., for shipping and handling) and a second position where it extends from the body portion for engaging the connector of an adjacent module.

The tab member(s) and the opening(s) are sized and positioned such that an extended tab member of one connector can be inserted through an opening of another connector to engage the connectors in at least two interlocking positions. In one interlocking position, the two connectors are close enough to each other to allow a worker to access the ends of both fixtures easily during installation of the fixtures, such as for making electrical connections, and provide adequate work space for moving the connected wires to a position where they will be invisible when installation is complete. Additionally, in this first interlocking position, one end of a module being installed can be supported by a previously hung module while the other end is suspended, thereby simplifying installation and reducing labor requirements. To facilitate engagement of the tab with the opening in the first position, the tab member may terminate in a hook distal from the joint between the tab and the body portion of the connector to which it is joined.

In the second position, the connectors are engaged such that the ends of the two fixtures abut each other, and the electrical wires are inside the fixtures and hidden from view. In a preferred embodiment, the tab member and the opening are sized and positioned such that the tapered sides of the tab member engage the tapered sides of the opening into which the tab is inserted as the two connectors are moved toward each other from the first position to the second position, and the wider portion of the tab member adjacent the joint is simultaneously and progressively guided to the widest portion of the corresponding tapered opening. The tabs and openings are also positioned such that, when connectors are in the second position, the fixtures to which the connectors are mounted are also aligned with each other. The connections between modules are thus self-aligning, as well as convenient to use and compact.

Preferably, each connector associated with each module end includes both a tab and an opening. More preferably, the connectors are identical, and the openings and tabs are positioned such that any two of the connectors can be paired, with one connector rotated 180 degrees relative to the other such that each tab member corresponds with an opening in the other connector in the pair. That is, the connectors are preferably of identical construction and are capable of mating engagement when arranged in mirror-image pairs. In this manner, construction is simplified and it is unnecessary to arrange modules in male-female series for assembly.

One aspect of the present invention involves a self-aligning engagement structure. The structure includes a body portion having at least one opening sized and shaped to accommodate a tapered tab connector from a connector on an adjacent fixture. The body portion may also include tapered tab connector, as described above, joined to the body portion at a joint. Preferably, the wide portion of the opening and the joint between the tab member and the body portion are located on opposite sides of a centerline of the assembled fixture. If the engagement structure is used for connecting light fixtures, the body portion preferably is adapted for enclosing electrical wires running between fixtures and for passing a power line into a module to which the connector is mounted. The body portion may also be adapted for supporting the fixture, such as by suspension from above or from a wall. The tab member preferably terminates in a hook for engaging an opening of an adjacent connector.

Another aspect of the present invention involves a method for making interlocking connectors for interconnecting modules of a modular fixture. The method includes the steps of providing a workpiece such as a flat sheet of metal, dimensioning the workpiece so as to allow the workpiece to be mounted to an end of one of the modules, bending the workpiece to form an end wall and a support section on opposite sides of a bend, and forming a tab connector on the end wall. The end wall may also include a tapered opening for receiving a tab connector of an adjacent module. The steps of dimensioning the workpiece and forming the tab connector involve, for example, cutting the workpiece such as by laser cutting or high precision punching. In the case where the fixture is a fluorescent light fixture, the method may further involve the steps of forming a support contour in the support section for engaging an end portion of a fluorescent light tube and forming a pass-through in the end wall and/or support section for passing electrical wires between adjacent modules. A separate or integral hanger attachment may be provided in connection with the interlocking connector for use in hanging the fixture. By virtue of such construction, the connector can be formed in large part from a single workpiece, thereby simplifying construction and reducing costs.

In yet another aspect, the present invention comprises a system for connecting and aligning fixture modules in an end-to-end relationship. In the system, there are at least two modules, each having a first end and a second end, and two connectors. The first connector includes a first body portion adapted for mounting at the first end of a first module and at least one tab member adapted for extension from the body portion beyond the first end of a module to which it is mounted. The second connector includes a second body portion adapted for mounting at the second end of the second module, with at least one tapered opening positioned to receive an extended tab member of the first connector. When the connectors are mounted to modules and interlocked with each other, the modules are forced into an aligned, butting relationship. The connectors may also be adapted to accommodate fasteners, such as screws or bolts, for securing adjacent connectors to each other to provide structural integrity for the fixture array.

According to a still further aspect of the present invention, a method is provided for installing modules to form a fixture. The method includes the steps of: providing first and second modules, the first module having a tab connector on an end thereof and the second connector having an opening on an end thereof; connecting one of the modules to a support structure; inserting the tab connector of the first module into the opening, of the second module to engage the modules in a first interlocking position where relative longitudinal motion between the modules is constrained (e.g., the modules resist moving apart); with the modules engaged in the first position, connecting the other of the modules to a support structure and/or running electrical wires between the modules; and progressively receiving the tab within the opening such that the modules are engaged in a second position wherein the modules are in an aligned abutting relationship. This two position process allows the modules to be preliminarily engaged for support, for example, while one of the modules is being hung or electrical connections are being made, thereby reducing the complexity or labor requirements of installation, and allows for simple alignment of the modules.

DESCRIPTION OF THE DRAWINGS

The present invention can be understood with reference to the following drawings, wherein:

FIG. 5(*b*) is a partial cutaway side view of the modules shown in FIG. 5(*a*), with connector tabs of the adjacent connectors engaged in accordance with the present invention;

FIG. 5(*c*) is a top perspective view of the modules shown in FIGS. 5(*a*) and 5(*b*), with the modules aligned and connected to each other in accordance with the present invention;

FIG. 6(*b*) is a perspective view of another connector in accordance with yet another embodiment of the present invention.

DETAILED DESCRIPTION

Figure 1:
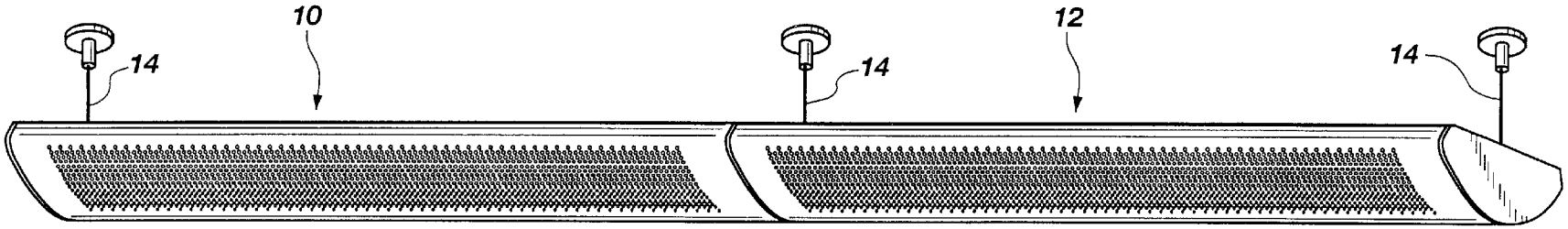
FIG. 1 is a perspective view of a linear modular light fixture suspended from a ceiling by sections of flexible cable, with the modules connected in accordance with the present invention.

The present invention relates to supported modular fixtures for use in architectural applications. These fixtures may be supported in any manner known to those skilled in the art, including suspension from above or from the side. In accordance with the present invention, the fixture modules 10 and 12 may be light fixture modules in a linear array, as shown in FIG. 1. Although only two modules 10 and 12 are shown in FIG. 1, any number of modules may be connected end-to-end, depending on the needs for a particular architectural setting. Alternatively, two or more modules may be arrayed in any geometric relationship. However, the preferred modules of the present invention are in physical contact with adjacent modules, with the modules mechanically connected to and aligned with each other, such that the outer surfaces present a substantially continuous appearance.

Any suspension device known in the art may be utilized. Preferred suspension devices include aircraft cable 14, as shown in FIG. 1, and rigid stems. Although not shown, one or more electrical cables may be used to provide power to modules 10 and 12, and the cable or cables wires may be incorporated into one or more of the support devices 14. For simplicity, the following discussion describes modules which are suspended from above, such as from a ceiling or other structural element. However, other means of support may be utilized, such as support from below on pedestals or from the side.

Figure 2:
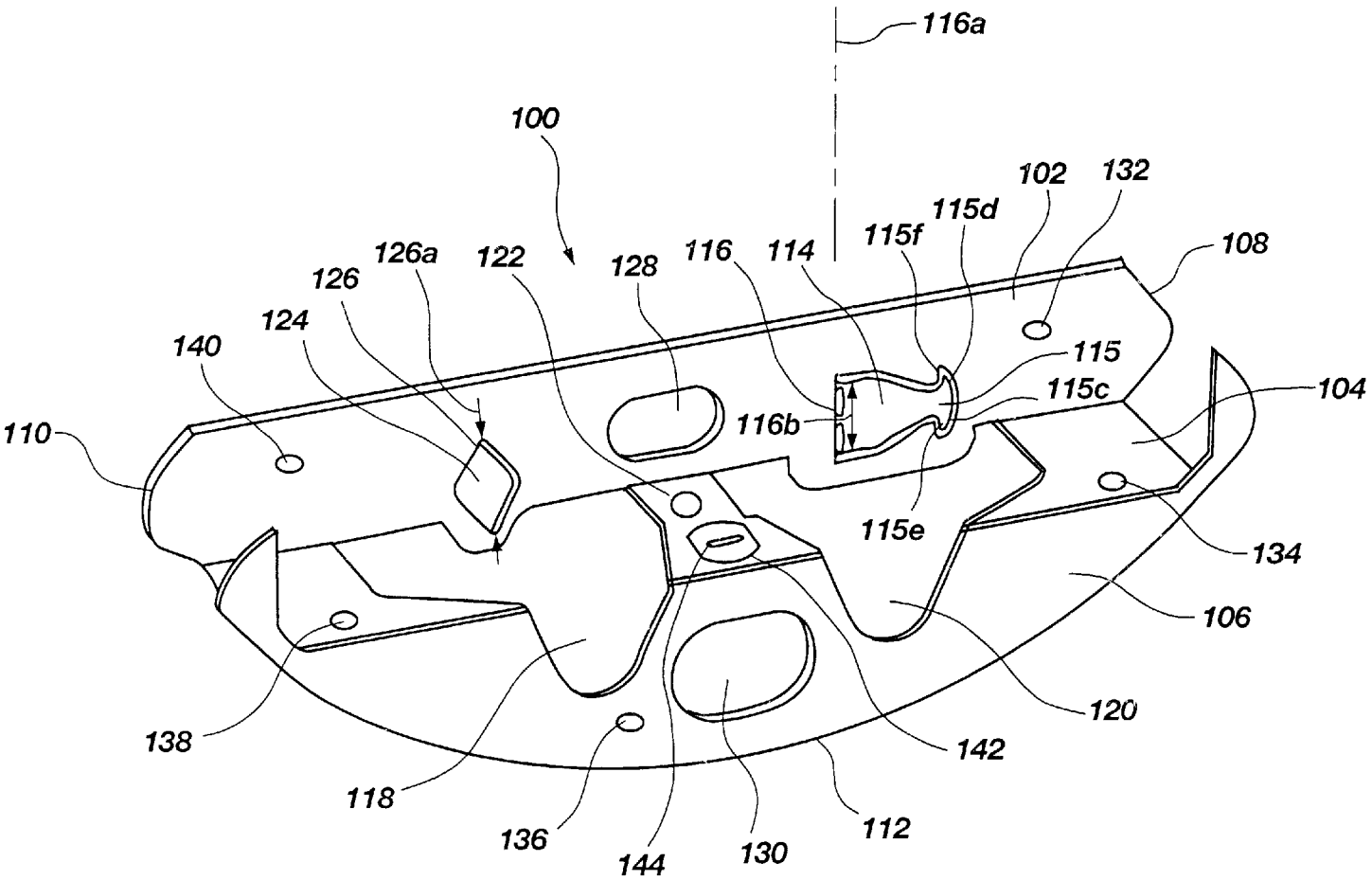
FIG. 2 is a perspective view of a connector in accordance with one embodiment of the present invention.

In accordance with one embodiment of the present invention, modules are joined by connectors, one of which is shown generally as 100 in FIG. 2. Connector 100 has a substantially planar wall member 102, a substantially planar fixture support member 104, and a substantially planar light tube support member 106. Fixture support member 104 is joined to wall member 102 and fixture support member 104 such that wall member 106 and fixture support member 104 are maintained in a substantially parallel relationship to each other and perpendicular to fixture support member 104. Outer edges 108, 110, and 112 of light tube support member 106 and wall member 102 are contoured for friction fitting inside a module, such as module 10 or 12 in FIG. 1.

Tab member 114 is attached to wall member 102 at joint 116. Although shown as substantially coplanar with wall member 102, tab member 114 can be extended substantially perpendicularly from wall member 102 in a direction away from fixture support member 104 and light tube support member 106. In this manner, the tab member 114 can be maintained flush with the wall member 102 for convenient shipping and handling and then deployed to an extended position (e.g., by hand or using a screwdriver or other tool) for engaging a connector of an adjacent module. Tab member 114 is widest adjacent joint 116 and wall member 102 and tapers to a smaller width distal from the joint. Preferably, tab member 114 terminates in a hooked end 115. It will be appreciated that the axis 116*a* of the joint 116 must be carefully positioned to provide proper alignment of the connected module.

Connector 100 is also adapted to accommodate several types of hardware which may be necessary for proper functioning of the fixtures. Openings 118 and 120 accommodate wiring for receptacles for the ends of fluorescent light tubes. These receptacles may be of a type well known in the art for supporting and making electrical contact with metal prongs at the ends fluorescent light tubes. An insert may be fitted into opening 122 for securing connector 100 to the end of a cable, stem, or other suspension device.

Opening 124 in wall member 102 is adapted for insertion therethrough of a tab member 114 of an adjacent connector, as will be discussed below. In this regard, opening 124 has a section 126 with dimension 126*a* closely matched to the dimension 116*b* of the widest portion of tab member 114. Section 126 and joint 116 are located on opposite sides of a center (generally indicated by line 127) and, more preferably, are positioned symmetrically with respect to the center of wall member 102, for reasons which will become apparent below. The size of opening 124 decreases with increasing distance 124*c* and 124*d;* from section 126. Opening 128 aids in attachment of a hanging device, such as 14. Opening 130 is adapted to accommodate electrical wires and cables. Openings 132, 134, 136, 138, and 140 are sized and positioned to accommodate fasteners, such as screws or bolts.

Figure 3:
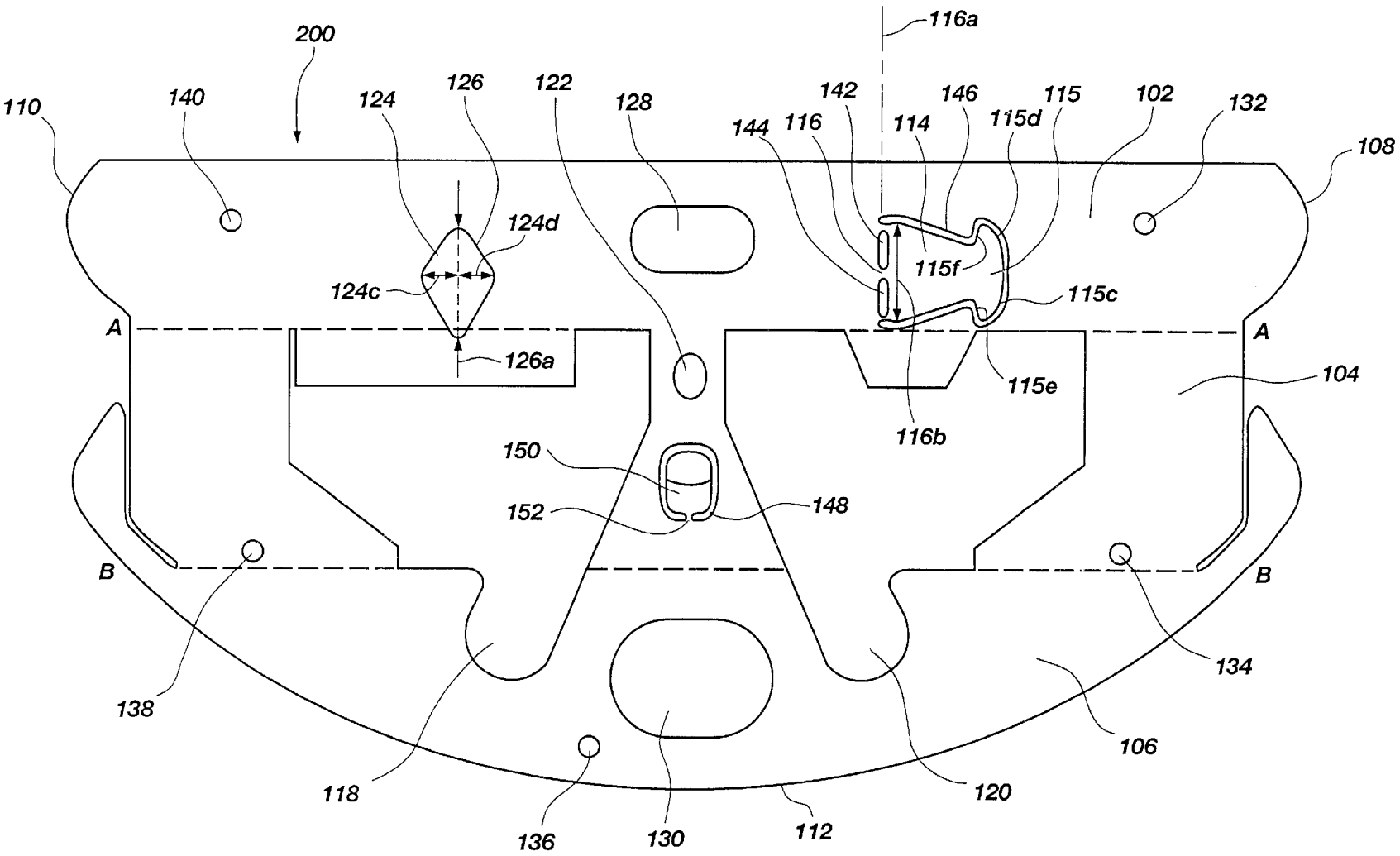
FIG. 3 is a plan view of a piece of sheet metal having cut edges and openings, suitable for making the embodiment shown in FIG. 2.

In a preferred embodiment, connectors, such as 100, can be manufactured from sheet metal, as shown in FIG. 3. A flat work piece 200 is cut from the sheet metal, with edges 108, 110, and 112 shaped and sized for fitting into fixture 10 or 12. The outline of tab member 114 and joint 116 between tab member 114 and wall member 102 are defined by cutting openings 142, 144, and 146. Opening 124 is cut to accommodate a tab from another connector. Openings 118 and 120 are cut into piece 200, with shapes appropriate for the wiring of particular light tube receptacles to be used with the fixture. Openings 130 and 148 are cut to accommodate electrical cables and wires which may be need to connect modules. As shown, opening 148 defines the outline of a removable plug 150 which is attached to the fixture support member 104 at joint 152. Plug 150 may be easily removed subsequently, if necessary, by bending plug 150 back and forth or otherwise severing the connection at joint 152.

Screw holes 132 and 140 are cut at appropriate locations for subsequent use in attaching the connector 100 to another connector, as described below.

The openings, edges, and other features of work piece 200 may be cut in any order or simultaneously, by any means known in the art. Preferably, a laser cutting device or high precision punching device is utilized to enhance the precision and accuracy of the cutting process and thus the fit between the connector and module housing, as well as the resulting alignment of the modules. After cutting is complete, manufacturing of connector 100 is completed by bending piece 200 along lines A—A and B—B so that wall member 102, fixture support member 104, and light tube support member 106 are arranged as shown in FIG. 3.

Figure 4:
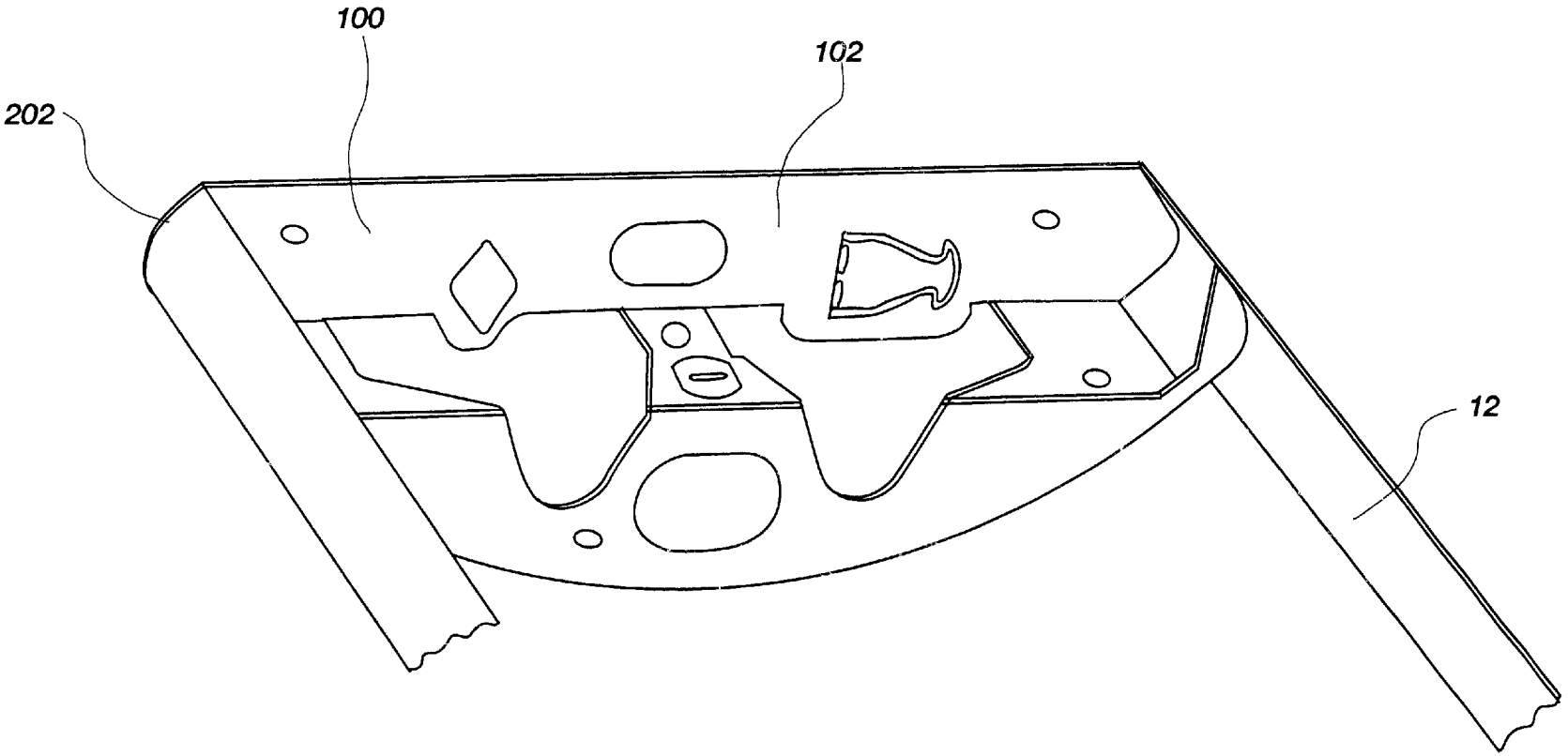
FIG. 4 is a perspective view showing a connector of the present invention which has been inserted into the end of a module.

As shown in FIG. 4, connector 100 is then inserted into a module, such as module 12, with wall member 102 aligned with the end 202 of module 12. Connector 100 may be secured in position in module 12 by any suitable method, such as by friction fitting, welding, or attachment to a support/positioning device within module 12. Tab member 114 may be left as cut, temporarily. However, it should be noted that, prior to connecting module 10 to module 12, tab 114 is bent away from wall member 102 to obtain the orientation shown in FIG. 2. Receptacles for the ends of light tubes and wiring are also installed, using the openings described above with reference to FIGS. 2 and 3. For simplicity, the modules in FIGS. 4 and 5 are shown without fluorescent light tubes and without receptacles for mounting the tubes.

The first module of a fixture is generally hung at both ends thereof. Thereafter, the connector of the present invention allows modules to be hung with a single support device at each connection between modules, as illustrated in FIGS. 2 and 5. In FIG. 5(*a*), a first module 10 has been suspended in position, with a threaded insert 302 mounted in opening 122, and hanger 14 supporting the end where a first connector 100*a* has been installed. The other end of module 10 is supported in a similar manner by another hanger 14 as shown in FIG. 2. The end of second module 12 which is adjacent module 10 and connector 100*a*, has been fitted with a second connector 100*b*. Each of modules 10 and 12 has been prewired with wires for providing electricity to illuminate fluorescent tubes which can be installed in the modules. Wire ends 304 have been left loose and hang from connectors 100*a* and 100*b*. Tabs 114*a* and 114*b* have been bent outward away from their respective modules 10 and 12. Tab 114*a* is approximately lined up with opening 124*b*, and tab 114*b* is approximately lined up with opening 124*a*.

Figure 5A:
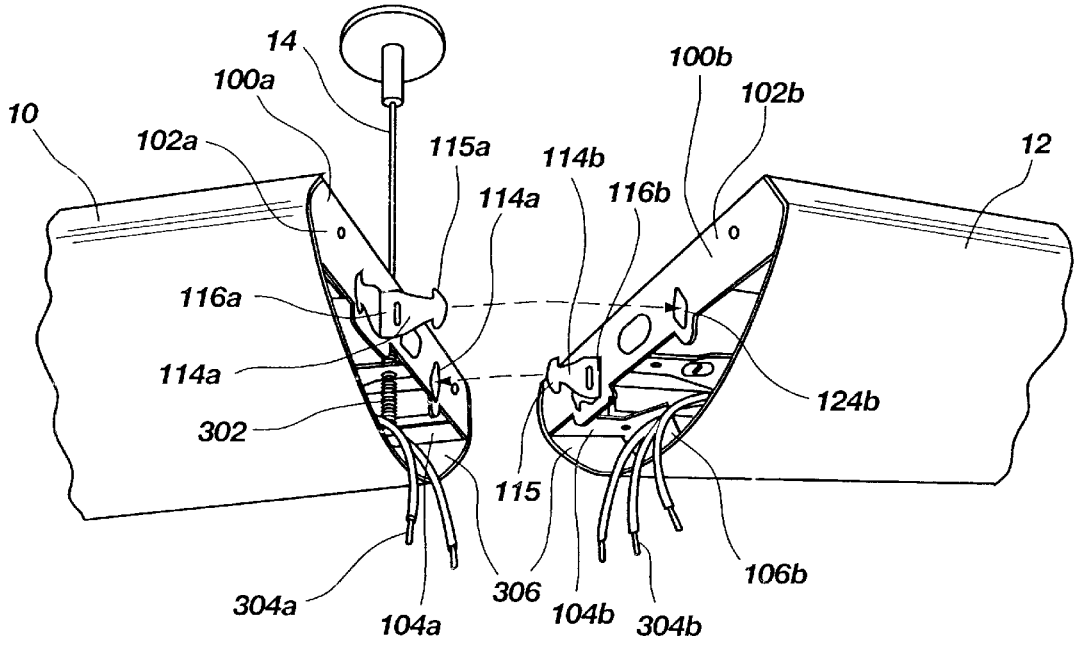
FIG. 5(*a*) is a perspective view from below showing one module which has been suspended in position with a connector according to the present invention mounted at the end of the module and showing an adjacent module, prior to connection with the first module, with a second connector according to the present invention mounted at the end adjacent the first module.
Figure 5B:
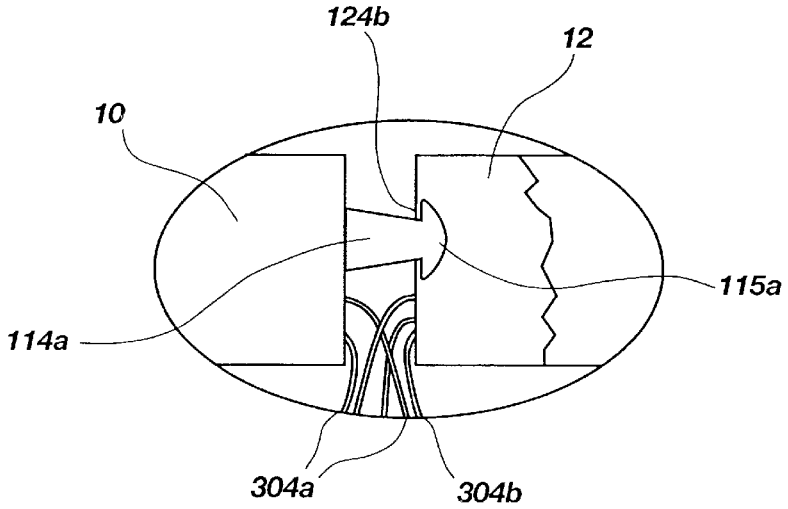
Figure 5C:
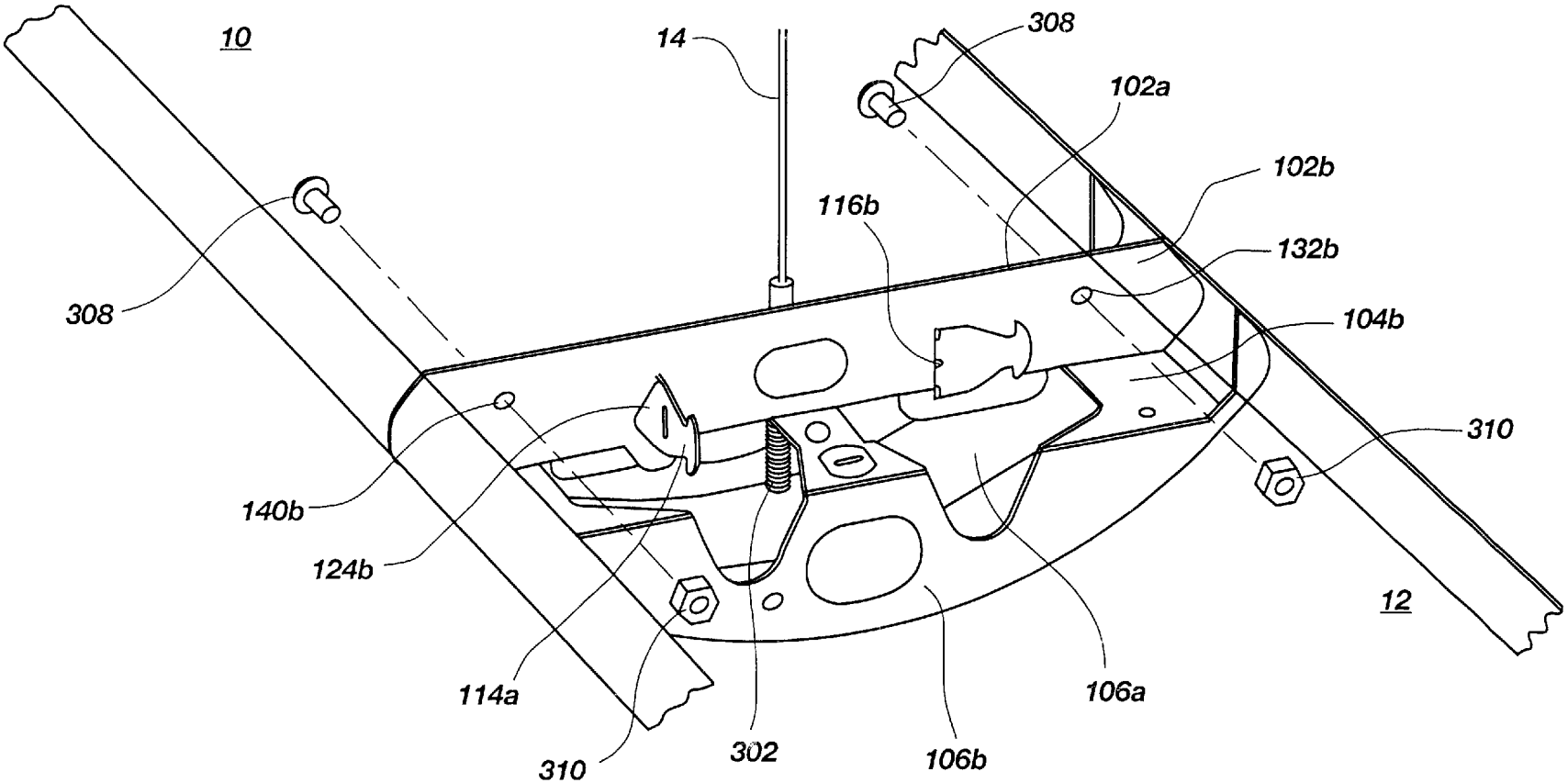

Referring now to FIGS. 5(*a*) and 5(*b*), installation of second module 12 is continued by moving the modules toward each other as indicated by the dashed arrows in FIG. 5(*a*). Hooked end 115*a* of tab 114*a* is inserted into opening 124*b*, and hooked end 115*a* thereby is engaged with wall member 102*b* of connector 12. Also, hooked end 115*b* of tab 114*b* is inserted into opening 124*a* and thereby engaged with wall member 102*a*. The engaged hooked ends 115*a* and 115*b* support module 12 temporarily are in a first position and resist pulling apart of the modules, allowing a single worker to use both hands for connection of wire ends 304 and suspension of the other end of module 12. In this regard, it is noted that, in this position, one of the tabs will rest against an upper end of the associated opening and the other tab will rest against a lower end of the associated opening to resist accidental detachment due to either upwardly directed or downwardly directed jarring forces or vibrations. After wire ends 304 have been connected, they can be pushed upwards into the space 306 defined between fixture support members 104*a* and 104*b*, light tube support members 106*a* and 106*b*, and the adjacent ends of modules 10 and 12. In this position, the other end of module 12 can be hung by a single worker while the module is supported by the connection with the previously hung module 10.

Next, the connectors 100*a* and 100*b* are put into a second position in which they are moved toward each other until wall members 102*a* and 102*b* are butted against each other. Because wall members 102*a* and 102*b* are aligned with the ends of modules 10 and 12, respectively, the module ends are also butted against each other, as illustrated in FIG. 5(*c*). The tapered sides of tabs 114*a* and 114*b*, in combination with the tapered sides of openings 124*a* and 124*b*, cause the connectors 100*a* and 100*b* and the modules 10 and 12 to progressively line up with each other as the connectors are moved toward each other. Connectors 100*a* and 100*b* are then secured to each other with suitable fasteners, such as bolts 308 extending through openings 132*a* and 140*b*, and through 140*a* and 132*b*, respectively, and secured with nuts 310.

It should be noted that the widest portions of the tabs 114*a* and 114*b* and of the openings 124*a* and 124*b* are sized so that each tab fits closely in the widest portion of the corresponding opening, thereby achieving secure attachment and vertical alignment. The joints 116*a* and 116*b* and the openings 124*a* and 124*b* are also positioned on the wall members 102*a* and 102*b* such that insertion of each tab in the corresponding opening on the adjacent connector will align the modules horizontally as desired. In a preferred embodiment, tab 114 and opening 124 (referring to FIGS. 2 and 3) are positioned such that they are symmetrically disposed on opposing sides of the center of wall member 102 such that the connectors can be of identical construction and interlock in an aligned relationship. Further, as illustrated in FIG. 5, connector 100*b* is identical to first connector 100*a*, but rotated 180 degrees (i.e., deployed in mirror image fashion) so that the two wall members 102*a* and 102*b* can be butted against each other. However, the connectors need not be identical, as long as the corresponding joints and openings match up with each to align the attached fixtures.

Figure 6A:
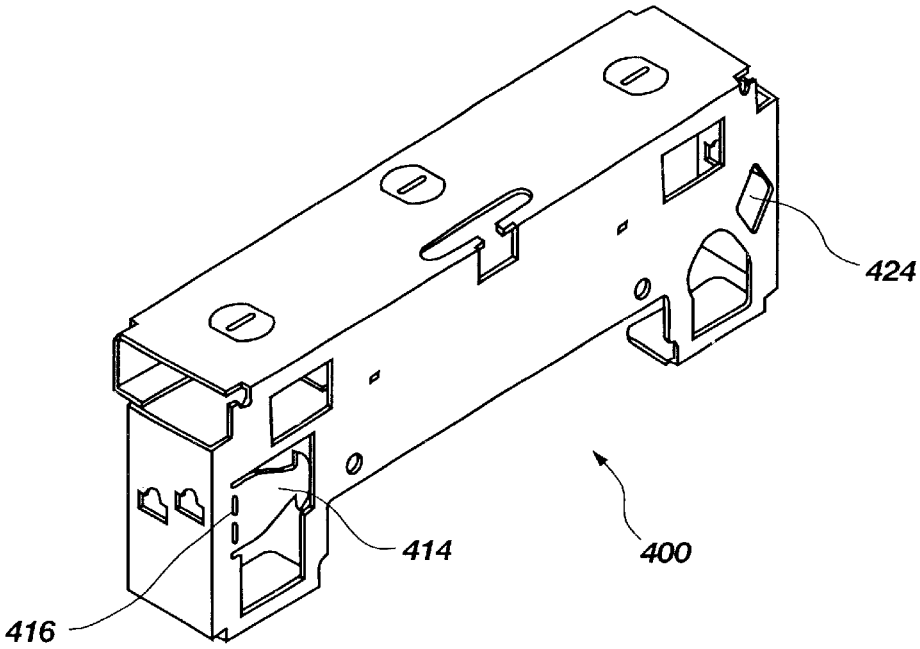
FIG. 6(*a*) is a perspective view of connector in accordance with another embodiment of the present invention.
Figure 6B:
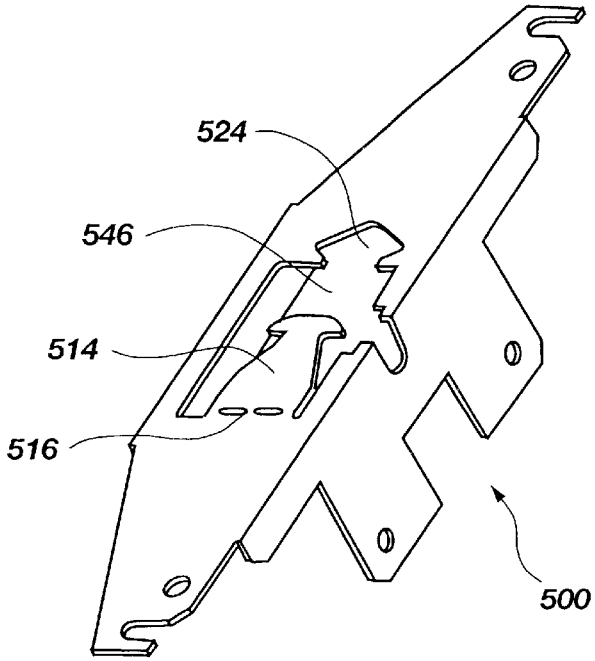

It should be appreciated that shape of each connector may be dictated, in part, by the shape of the fixture module in which it is mounted. Further, connectors in accordance with the present invention may have different configurations of tabs and openings. For example, connector 400 in FIG. 6*a* has a tab member 414, a joint 416, and an opening 424 for interlocking and alignment with a mating connector. Similarly, in connector 500, shown in FIG. 6*b*, tab member 514 has been formed to extend into a larger opening 546 from joint 516. A portion 524 of opening 546 is tapered to receive a tab member from an adjacent connector. It should be noted that each connector may include more than one tab member and/or more than one opening for receiving tab members. However, for proper alignment of the fixtures, the corresponding joints and openings should match up with each other.

The fixtures illustrated and described herein are fluorescent light fixtures, although the present invention could be used with other types of fixtures. It is contemplated that the illustrated fixtures may be open on top, as shown in FIGS. 4 and 5(*c*), or that the fixtures have top covers. Alternatively, the fixtures may be open at the bottom or open at both the top and the bottom. After installation of the illustrated modular fixtures has been completed, fluorescent bulbs can be inserted into the receptacles in the modules.

It should be noted that the other configurations of portions and members of the connectors are possible. However, it is preferred that the connectors are configured so they are functional to aid in supporting the fixtures to which they are mounted and light tubes used in the fixtures, as well as to provide for interlocking, self-aligning connections between modules. The connectors can be formed from any suitable material. Also, the connectors can be mounted to the modules by any suitable method known in the art.

While specific embodiments of this invention have been disclosed, it is expected that those skilled in the art can and will design alternate embodiments of this invention that fall within the scope of the appended claims.

What is claimed is:

1. Apparatus for connecting and aligning first and second modules in an abutting, end-to-end relationship so as to form an elongate fixture, said apparatus comprising:

a first end portion adapted for mounting at an end of a first module, said first end portion including a first opening away from said first end portion, said first tab member having a distal end with hook structure; and a second end portion adapted for mounting at an end of a second module, said second end portion including a second opening sized and configured to receive said hook structure of said first tab member when said first tab member is in said second tab position and a second tab member unitarily formed with said second end portion and formed to be moveable from a third tab position to a fourth tab position in which said second tab member extends away from said second end portion, said second tab member having a distal end with hook structure and said second tab member being sized to be received by said first opening; and said first end portion and said second end portion being positioned in a first orientation spaced from each other to form a space therebetween sized for access by the user and a second orientation in which said first end portion and said second end portion are urged together to be proximate each other, said hook structure of said first tab member engaging said second opening and said hook structure of said second tab member engaging said first opening to retain said first end portion and said second end portion in said first orientation.

2. Apparatus according to claim 1, wherein said first end portion has a first wall member and wherein said second end portion has a second wall member configured to abut said first wall member when said modules abut one another in said end-to-end relationship.

3. Apparatus according to claim 1, wherein said first member is joined to said first end portion at a first joint, said first member having a wide portion adjacent said joint, a narrow portion, and a tapering portion between said wide portion and said narrow portion.

4. Apparatus according to claim 1, wherein at least one of said first end portion and said second end portion include means for supportably interconnecting said first module to a support structure.

5. Apparatus according to claim 4, wherein said means for supportably interconnecting said first module to a support structure comprises means for mounting said first module on a wall.

6. Apparatus according to claim 1, wherein said fixture is an electrical fixture, and wherein said first end portion and said second end portion are formed for passage of electrical line there through, and wherein said space in said first orientation is sized to receive said electrical line.

7. Apparatus according to claim 6, wherein at least one of said first module and said second module is configured to support at least one fluorescent light tube.

8. Apparatus according to claim 1 wherein said preselected distance is selected to provide a work space between said first module and said second module.

9. The apparatus of claim 1 wherein said first tapered opening has a wide portion and a narrow portion relative to said wide portion, wherein said second end of said second member is narrow relative to said first end of said second member and has means for connecting said second member to said narrow portion of said first tapered opening when said first end portion is spaced said first preselected distance from said second end portion.

10. The apparatus of claim 9 wherein said first end of said second member is sized to securely engage said first tapered opening proximate said wide portion when said first end portion abuts said second end portion.

11. The apparatus of claim 9 wherein said means for connecting includes a shoulder and a lip configured to engage said first opening when said first end portion is spaced said first preselected distance from said second end portion.

12. The apparatus of claim 9 wherein said first tapered opening is diamond shaped.

13. The apparatus of claim 12 wherein said second tapered opening has a wide portion and a narrow portion relative to said wide portion, wherein said second end of said first member is narrow relative to said first end of said first member and has means for connecting to said narrow portion of said second tapered opening when said first end portion is spaced said first preselected distance from said second end portion, and wherein said first end of said first member is sized to securely engage said second tapered opening when said first end portion abuts said second end portion.

14. The apparatus of claim 13 wherein said second tapered opening is diamond shaped.

15. A system for connecting and aligning modules in an end-to-end relationship, the system comprising:

a first module having a first end and a second end;

a second module having a first end and a second end;

a first body portion adapted for engagement with said first end of said first module, said first body portion including at least one tab member irremovably fixed to and adapted to extend from said first body portion, said at least one tab member being attached to said first body portion at a joint, said tab member having a first width proximate said joint, said tab member being formed with its width decreasing from said first width to a smaller width spaced from said joint; and a second body portion adapted for engagement with said second end of said second module, said second body portion having formed therein a tapered opening having first and second sections, said second section having an area that is smaller in cross section than a corresponding area of said first section, said tapered opening being positioned to register with and sized to receive said tab member of said first body portion in a first position in which said second body portion is spaced a preselected distance from said first body portion to define a work space therebetween and in which said tab member engages said second section at said smaller width, said tapered opening being configured to frictionally secure said tab member in a second position in which said tab member is frictionally secured to said first section of said tapered opening with said first end of said first module in abutting alignment with said second end of said second module.

16. A system according to claim 15, wherein said tab member of said first body portion has a distal end spaced from said joint and means proximate said distal end to engage and hold said first module at said preselected distance from said second module.

17. A system according to claim 15, wherein said first module and said second module are electric light fixtures and each of said first body portion and said second body portion are configured for passage of electrical wires.

18. A system according to claim 15, wherein said first module and said second module are configured to receive at least one fluorescent tube each and wherein said first body portion and said second body portion are configured to minimize space between adjacent ends of said fluorescent tubes when said first end of said first module alignigly abuts said second end of said second module.

19. A system according to claim 15, further including fastening means for fastening said first body portion and said second body portion to one another when said first end of said first module alignigly abuts said second end of said second module.

20. An apparatus for connecting and aligning modules in an abutting, end-to-end relationship so as to form an elongate fixture, including:

a first end portion adapted for mounting at an end of a first module, said first end portion including a first tapered opening, said first opening having a first section and a second section spaced from said first section, said second section having a length that is smaller in magnitude than a corresponding length of said first section; and a second end portion adapted for mounting at an end of a second module, said second end portion including a member irremovably fixed to and extending from said second end portion and positioned to register with said first tapered opening in a first position in which said first end portion is connected to and retained spaced from said second end portion a preselected distance selected to form a work space there between and a second position in which said second module and said first module are held abutted to each other, said member being fixed to said second end portion at a joint and having a wide portion adjacent said joint, a narrow portion and a tapered portion intermediate said wide portion and said narrow portion.

21. A method for connecting and aligning modules in an end-to-end relationship, said method comprising:

providing a first module having first wires extending from a first end;

providing a first end portion formed and sized for mounting in a first end of said first module with said first wires extending therepast, said first end portion having a tab member formed therein to extend substantially normal thereto;

providing a second module having second wires extending from a second end;

providing a second end portion formed and sized for mounting in said second module with said second wires extending therepast, said second end having engagement means sized to received said tab member thererthrough;

securing said first end portion to said first module;

securing said second end portion to said second module;

securing said first module to a support structure;

moving said second module toward said first module to progressively receive said tab member in said engagement means to a first position in which said first end portion and said second end portion are spaced apart a working distance to form a space;

wiring the said first wires of said first module and second wires of said second module together and placing said wired together first wires and second wires in said space between said first module and said second module; and moving said first end portion toward said second end portion to insert said tab member into said engagment means in a second position in which said first module and said second module are in abutment.

22. An apparatus for connecting and aligning two lighting fixture modules in an abutting, end-to-end relationship so as to form an elongate fixture, said apparatus comprising:

a first end portion adapted for mounting proximate an end of a first lighting fixture module, said first end portion including first aligning engagement means for receiving a second tapered tab and said first end portion including a first tapered tab extending therefrom a preselected distance; and a second end portion adapted for mounting proximate an end of a second lighting fixture module, said second end portion including second aligning engagement means for receiving said first tapered tab from said first end portion, said second aligning engagement means being sized and shaped to receive and engage said first tapered tab in a first position in which said first and second modules are constrained to maintain an alligned, relationship and a second position in which first and second modules are joined end to end, said second end portion having said second tapered tab extending therefrom a preselected distance, said first aligning engagement means including structure defining an opening for receiving said second tapered tab in a first position in which said first and second modules are spaced apart and a second position in which said first and second modules are joined end to end, said first aligning engagement means and said second aligning engagement means each being an opening having a wide central portion and narrower side portions, wherein said first tapered tab and said second tapered tabs each have a first, narrow end which can be received within said narrower side portions of their respective openings and said wide central portion of said opening is dimensioned to securely engage a second, wide end of each of said first tapered tab and said second tapered tab such that said first and second modules are forced into said aligned, end-to-end relationship as said first tapered tab and said second tapered tab is progressively received within their respective opening from said first end to said second end of said tab connector, and wherein said first end portion and said second portion each comprises a wall member.

23. Apparatus for connecting and aligning modules in an abutting, end-to-end relationship so as to form an elongate fixture, said apparatus comprising:

a first end portion adapted for mounting at an end of a first module, said first end portion including first aligning engagement means and a first connector joined to said first end portion at a first joint, said first connector extending away from said first end portion, and said first connector having a wide portion adjacent said joint, a narrow portion, and a tapering portion between said wide portion and said narrow portion; and a second end portion adapted for mounting at an end of a second module, said second end portion including second aligning engagement means positioned to receive said first connector in a first position in which said first end portion is connected to and spaced from said second end portion a preselected distance and a second position in which said first end portion and said second end portion are positioned with said second module and said first module abutting each other, and said second end portion having a second connector extending from said second end portion and positioned to register with said first aligning engagement means in a first position in which said first end portion is connected to and spaced from said second end portion said preselected distance and said second position in which said second module and said first module abut each other in an aligned, end-to-end relationship.

24. Apparatus for connecting and aligning modules in an abutting, end-to-end relationship so as to form an elongate fixture, said apparatus comprising:

a first end portion adapted for mounting at an end of a first module, said first end portion including first aligning engagement means and a first connector extending from said first end portion, said first aligning engagement means including a first opening for receiving a second connector, said first opening having a wide portion and a narrow portion relative to said wide portion; and a second end portion adapted for mounting at an end of a second module, said second end portion including second aligning engagement means positioned to receive said first connector in a first position in which said first end portion is connected to and spaced from said second end portion a preselected distance and a second position in which said first end portion and said second end portion are positioned with said second module and said first module abutting each other, and said second end portion having a second connector extending from said second end portion and positioned to register with said first aligning engagement means in a first position in which said first end portion is connected to and spaced from said second end portion said preselected distance and said second position in which said second module and said first module abut each other in an aligned, end-to-end relationship, second connector having a second distal end that is narrow relative to its second proximal end, said second distal end being sized to fit within said first opening in said first position, and said second distal end having second means for connecting to said first opening in said first position, and said second proximal end being sized to securely engage in said first opening in said second position.

25. An fixture having a plurality of modules in an abutting, end-to-end relationship said fixture, including:

a first module, said first module having means for connection to a support surface;

a first end portion mounted at an end of said first module, said first end portion including a first opening formed therein;

a second module positioned in a first orientation spaced from said first module a distance to form a space to receive electrical wires from said first module and said second module therebetween, said second module having means for connection to a support surface, and said second module being moveable into a second orientation in which said first module and said second module are in abutment to form said fixture;

a second end portion mounted at an end of said second module, said second end portion including a tab member unitarily formed with said second end portion to be moveable between a first position oriented toward said second end portion and a second position extending away from said second end portion, and said tab member having a hook member and said tab member being sized for said hook member to engage said first opening to hold said first module and said second module in said first orientation, and said tab member and said first opening being sized to receive said tab member substantially entirely in said first opening to hold said first module and said second module in said second orientation.

* * * * *